US010865553B2

(12) United States Patent
Breed et al.

(10) Patent No.: US 10,865,553 B2
(45) Date of Patent: Dec. 15, 2020

(54) TOILET FLUSHING SYSTEM INSTALLED IN A TOILET RESERVOIR

(71) Applicants: Richard Corey Breed, Austin, TX (US); Kurt Herloff Petersen, Austin, TX (US)

(72) Inventors: Richard Corey Breed, Austin, TX (US); Kurt Herloff Petersen, Austin, TX (US)

(73) Assignee: Richard Corey Breed, Austin, TX (US)

( * ) Notice: Subject to any disclaimer, the term of this patent is extended or adjusted under 35 U.S.C. 154(b) by 0 days.

(21) Appl. No.: 16/451,487

(22) Filed: Jun. 25, 2019

(65) Prior Publication Data

US 2019/0309505 A1 Oct. 10, 2019

Related U.S. Application Data

(63) Continuation of application No. 15/592,143, filed on May 10, 2017, now Pat. No. 10,370,836.

(51) Int. Cl.
*E03D 1/28* (2006.01)
*E03D 5/092* (2006.01)
*E03D 1/34* (2006.01)

(52) U.S. Cl.
CPC ..... *E03D 1/283* (2013.01); *E03D 1/34* (2013.01); *E03D 5/092* (2013.01)

(58) Field of Classification Search
CPC ..... E03D 1/283
USPC ..... 4/331
See application file for complete search history.

(56) References Cited

U.S. PATENT DOCUMENTS

| | | | |
|---|---|---|---|
| 4,498,203 | A | 2/1985 | Barnum |
| 5,970,527 | A | 10/1999 | Martin |
| RE37,921 | E | 12/2002 | Martin |
| 6,732,997 | B2 | 5/2004 | Beh |
| 6,896,237 | B2 | 5/2005 | Beh |
| 2001/0027572 | A1 | 10/2001 | Beh |
| 2004/0021110 | A1 | 2/2004 | Beh |
| 2005/0161625 | A1 | 7/2005 | Beh |

OTHER PUBLICATIONS

Pre-Interview First Office Action dated Jan. 10, 2018 in U.S. Appl. No. 15/592,143.
Final Office Action dated May 10, 2018 in U.S. Appl. No. 15/592,143.
Advisory Action dated Jun. 21, 2018 in U.S. Appl. No. 15/592,143.
Non-Final Office Action dated Oct. 30, 2018 in U.S. Appl. No. 15/592,143.

*Primary Examiner* — Lori L Baker

(57) ABSTRACT

Toilet flushing systems installed in a toilet reservoir. A toilet reservoir stores a fluid that pours into a toilet bowl for carrying waste away from a toilet. Exemplary toilet flushing systems may include a flush sleeve having a sleeve bottom and sleeve top. The exemplary sleeve bottom may connect to a bottom of the toilet reservoir around a reservoir drain. The flush sleeve may be capable of being raised in a raised orientation such that the sleeve top is above the fluid in the toilet reservoir to prevent the fluid from entering the reservoir drain. Exemplary toilet flushing systems may include a flush sleeve actuator that lowers the sleeve top of the flush sleeve below a fluid level in the toilet reservoir to allow the fluid to flow through the flush sleeve into the reservoir drain.

6 Claims, 10 Drawing Sheets

TOILET FLUSHING SYSTEM INSTALLED IN A TOILET RESERVOIR

This application claims the benefit of and is a continuation of Non-Provisional application Ser. No. 15/592,143 entitled "A Toilet Flushing System Installed In A Toilet Reservoir" and filed on May 10, 2017, which is incorporated herein by reference in its entirety for all purposes.

TECHNICAL FIELD

The present invention relates to the field of toilet flushing systems installed in a toilet reservoir.

BACKGROUND ART

Flush toilets are commonly used throughout the world to dispose of human waste (e.g., urine and feces) by using water to flush such waste through a drainpipe to another location for processing and further disposal. Flush toilets may be designed for a variety of usage configurations. For example, many flush toilets in the Western hemisphere are designed such that a user sits on the toilet when relieving himself or herself of urine or feces. In other configurations, a flush toilet may be designed for use by squatting over the toilet.

For an example of a traditional flush toilet, FIGS. 1A and 1B set forth a prior art toilet (100) having a toilet tank (102) and toilet bowl (104). The toilet (100) of FIGS. 1A and 1B is made up of a vitreous, ceramic material and plumbing to rapidly fill the bowl (104) with water stored in the reservoir (102). The water in the toilet bowl (104) is connected to a hollow drain pipe (106) through a channel (110) shaped like an upside-down U commonly referred to as a 'trap'. One side of the U channel (110) is configured longer than the bowl (104) is high so that as water fills the longer side of the U channel (110) its creates a syphoning action as the water flowing toward the drain (106) draws the water (along with any waste) out of the bowl (104) and down the drain (160). The top of the upside-down U-shaped trap (110) limits the height of the water in the bowl before it flows down the drain (106). If water is poured slowly into the bowl (104) it simply flows over the rim of the upside-down U trap (110) and pours slowly down the drain (106)—and thereby the toilet (100) does not 'flush.' The standing water in the bowl (104) acts as a barrier to sewer gas coming out of the sewer through the drain (106), and also as a receptacle for waste.

The toilet reservoir (102), also commonly referred to as a 'tank,' of FIGS. 1A and 1B stores the water that is used to rapidly fill the toilet bowl (104) when a user triggers the flushing mechanism. The flow of water from the reservoir (102) of FIGS. 1A and 1B to the bowl (104) is regulated by a flapper valve (108), commonly referred to merely as the 'flapper.' When a user flushes the toilet, the flapper valve (108) opens and allows water from a reservoir tank (102) to quickly enter the toilet bowl (104). This rapid influx of water from the reservoir (102) causes the swirling water in the bowl to rapidly rise and fill the inverted U-shaped siphoning channel (110) mounted in the back of the toilet (100). Filling the U-shaped channel (110) of FIGS. 1A and 1B starts the siphoning action that rapidly pulls the water and waste in the bowl (104) and the water down the drain (106)—thereby flushing the toilet (100). When most of the water has drained out of the bowl (104), air enters the U-shaped channel (110) thereby breaking the siphonic action of the column of water traveling down toward the drain (106). The toilet then produces its characteristic 'gurgle' as the siphonic action ceases and no more water flows out of the toilet. After flushing, the flapper valve (108) in the water tank (102) closes, and water lines and valves connected to the water supply refill the toilet tank (102), and the toilet (100) is ready for use.

According to the American Water Works Association (AWWA), toilets are responsible for approximately twenty-seven percent (27%) of the water used in homes on a daily basis. This amount only increases when there is a water leak—resulting in an incredible loss of water. Moreover, some leaks go undetected for long periods of time. The flapper valve is the most common culprit of a leaking toilet. The flapper valve is supposed to form a watertight seal to hold the water in the reservoir tank, but after a period of time, the flapper valve material begins to deteriorate or collect mineral or other deposits that render this water tight seal ineffective. When this occurs, water begins to leak around the flapper valve into the toilet bowl. Moreover, this most common leak can be difficult to detect because the leaking is silent. Such toilet leaks result in a tremendous amount of water loss—as much as 300 gallons of water by some estimates. Due to the tremendous loss of water due to flapper leaks, there is clearly room for improvements regarding the toilet flushing systems installed in toilet tanks.

SUMMARY OF INVENTION

The present invention discloses toilet flushing systems installed in toilet reservoirs. A toilet reservoir stores a fluid that pours into a toilet bowl for carrying waste away from a toilet. The toilet flushing system includes a flush sleeve having a sleeve bottom and sleeve top. The sleeve bottom is connected to a bottom of the toilet reservoir around a reservoir drain. The flush sleeve capable of being raised in a raised orientation such that the sleeve top is above the fluid in the toilet reservoir to prevent the fluid from entering the reservoir drain. The toilet flushing systems includes a flush sleeve actuator that lowers the sleeve top of the flush sleeve below a fluid level in the toilet reservoir to allow the fluid to flow through the flush sleeve into the reservoir drain.

A flush sleeve may include a weighted sleeve collar configured at the sleeve top, and the weighted sleeve collar may have a collar slot for receiving a detent. The flush sleeve actuator may include a detent that slides out of the collar slot such that sliding out of the collar slot allows the flush sleeve to drop below the fluid level in the toilet reservoir.

Moreover, a toilet flushing system according to embodiments of the present invention may include one or more sleeve rails to guide the weighted sleeve collar vertically inside the toilet reservoir.

Still further in some embodiments, an exemplary toilet flushing system may include an inner sleeve tube extending upward from the reservoir drain inside the weighted sleeve collar to guide the weighted sleeve collar vertically inside the toilet reservoir. The inner sleeve tube may have one or more openings to allow the fluid from the toilet reservoir to flow into the reservoir drain when the flush sleeve drops below the fluid level in the toilet reservoir.

Exemplary toilet flushing systems may also include a float collar configured around the flush sleeve such the float collar is configured to float on the fluid in the toilet reservoir.

The flush sleeve actuator of exemplary embodiments may include a detent configured on the float collar that slides into a collar slot on the flush sleeve to engage the float collar with the flush sleeve such that the flush sleeve rises with the fluid level on which the float collar floats. In some exemplary toilet flushing systems at least a portion of the detent is configured from magnetic material. In other exemplary toilet flushing systems at least a portion of the collar slot is configured from magnetic material. Exemplary toilet flushing systems may include a detent operatively connected to a toilet tank handle such that the detent is removed from the collar slot when the toilet tank handle is operated by a user.

Still further, in some embodiments, one or more float rails guide the float collar vertically inside the toilet reservoirs, and float rails position the float collar to engage the flush sleeve as the float collar descends with the fluid level in the reservoir tank.

Other exemplary embodiments of a toilet flushing system include a reservoir drain pipe extending upward from a reservoir drain in a base of a toilet reservoir. Such embodiments of a toilet flushing system include a flush cap connected around the reservoir drain pipe in a closed position that prevents the fluid from entering the reservoir drain. The flush cap in such embodiments has a sealed top that traps air inside the flush cap forcing the fluid below the top of the reservoir drain pipe when the flush cap is lowered to the closed position. Such embodiments of a toilet flushing system also include a flush cap actuator connected to the flush cap and capable of raising the flush cap to an open position such that a bottom of the flush cap is positioned above the top of the reservoir drain pipe to allow the fluid to flow through the reservoir drain pipe into the reservoir drain.

These exemplary embodiments of a toilet flushing system may also include one or more cap guides positioned vertically around the flush cap to maintain a vertical orientation of the flush cap over the reservoir drain pipe as the flush cap moves up and down. The flush cap of such embodiments may be operatively connected to a toilet tank handle such that the flush cap is raised when the toilet tank handle is operated by a user. The flush cap in these embodiments may be further configured such that a gap exists between an inner surface of the flush cap and an outer surface of the drain pipe even when the flush cap is in the closed position.

BRIEF DESCRIPTION OF DRAWINGS

The accompanying drawings, which are incorporated in and constitute a part of this specification, illustrate an implementation of apparatus and methods consistent with the present invention and, together with the detailed description, serve to explain advantages and principles consistent with the invention. In the drawings, FIG. 1A sets forth a prior art toilet.

DESCRIPTION OF EMBODIMENTS

Figure 1A:
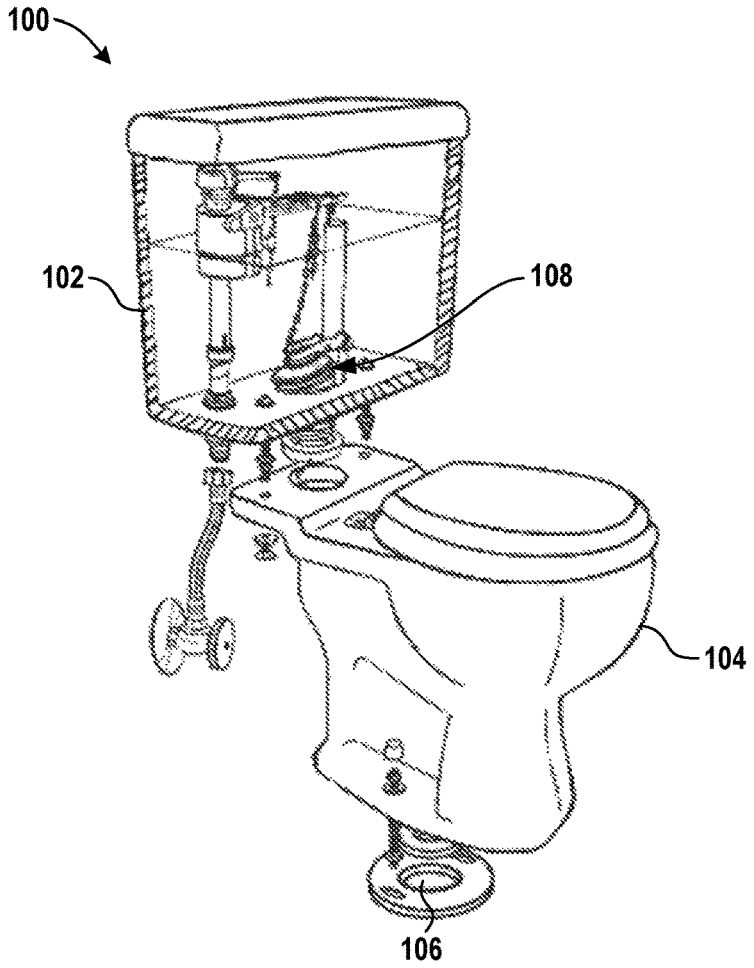
FIG. 1A PRIOR ART
FIG. 1B sets forth a prior art toilet.
Figure 1B:
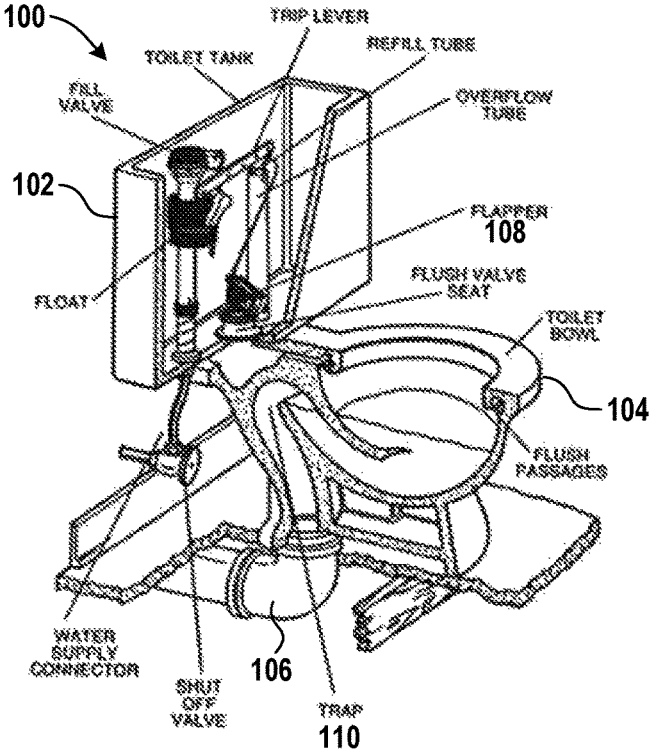
FIG. 1B PRIOR ART

Exemplary embodiments of toilet flushing systems installed in a toilet reservoir according the present invention are described herein with reference to the accompanying drawings, beginning with FIGS. 2A-D. FIGS. 2A-D set forth line drawings illustrating a perspective view of an exemplary toilet flushing system (200) installed in a toilet reservoir (202) according to embodiments of the present invention. The toilet reservoir (202) of FIGS. 2A-D is shown without a corresponding toilet bowl in FIGS. 2A-D for clarity with regard to the exemplary embodiments of the invention. Clearly, from the prior art FIGS. 1A and 1B, one of skill in the art would understand the relationship between the toilet reservoir (202) and how this component would connect to a toilet bowl (not shown in FIGS. 2A-D, but shown in FIGS. 1A-B as 104). In addition, the toilet tank filling mechanism is also left out of the drawing and descriptions. One of skill in the art would understand the relationship between the toilet reservoir and how these filling mechanisms could be utilized with embodiments of the present invention.

Figure 2A:
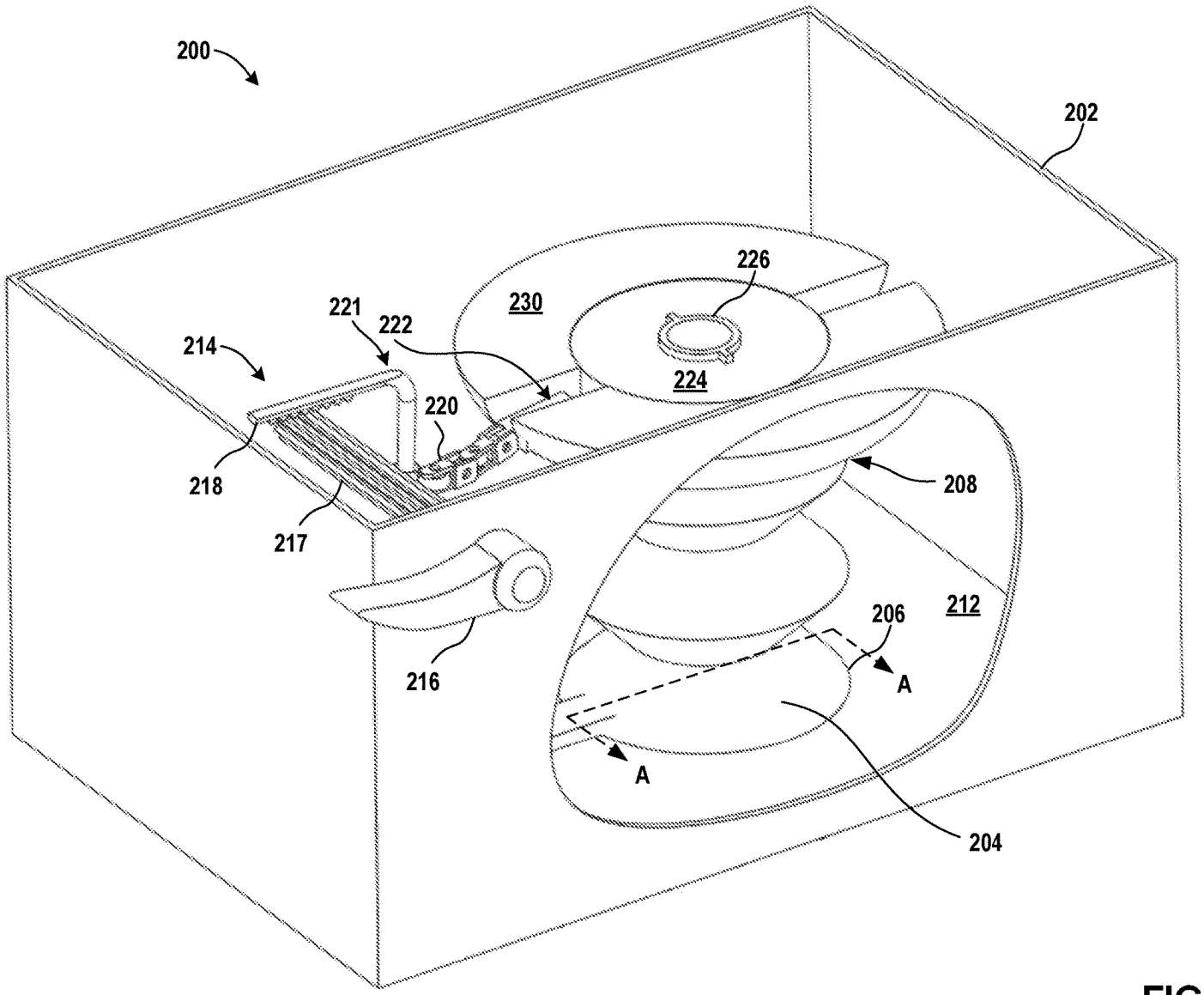
FIG. 2A sets forth line drawings illustrating a perspective view of an exemplary toilet flushing system installed in a toilet reservoir according to embodiments of the present invention.

The toilet reservoir (202) of FIG. 2A operates as a storage reserve for a fluid that pours into a toilet bowl for carrying waste away from a toilet. Typically, the fluid that flushes away the waste from the toilet bowl is implemented using water, but other liquids would also be sufficient for use with embodiments of the present invention. In general, any fluid that would work with current toilet flushing systems could also be used with embodiments of the new and improved toilet flushing systems described herein according to the present invention.

The toilet flushing system (200) of FIGS. 2A-D includes a flush sleeve (204). The flush sleeve (204) of FIGS. 2A-D is telescoping tube capable of varying in length. The telescoping nature of the flush sleeve (204) of FIGS. 2A-D is derived from the accordion structure. One of skill in the art will recognize, however, that such a structure is for example only and not for limitation. Other telescoping structures may include short tubular segments arranged concentrically around one another and allowed to slide so that the adjacent segments lock together end upon end. In this way, the shortest length of such a structure would be the length of the longest tube segment but the longest length would be the length of all of the segments combined when the structure is fully expanded. The exemplary flush sleeve (204) of FIGS. 2A-D is made of plastic, but other materials as will occur to those of skill in the art may also be useful in making a flush sleeve according to embodiments of the present invention such as for example rubber. In the example of FIGS. 2A-D, the outer and inner ridges of the flush sleeve (204) may be reinforced with metal or plastic rings formed into the ridges of the flush sleeve (204).

In the example of FIGS. 2A-D, the flush sleeve (204) has a sleeve bottom (206) and a sleeve top (208). The sleeve bottom (206) of FIGS. 2A-D is connected to a bottom of the toilet reservoir (202) around a reservoir drain. For further discussion of the reservoir drain, turn to FIG. 3. FIG. 3 sets forth a drawing illustrating a perspective view of the exemplary toilet reservoir (202) shown in FIGS. 2A-D according to embodiments of the present invention. The other components of an exemplary toilet flushing system according to embodiment of the present invention have been omitted for clarity to allow illustration of the reservoir drain (210). For clarity, the reservoir drain (210) of FIG. 3 is not be confused with the toilet drain through which waste is removed from the toilet bowl and expelled into a septic or sewer system. Rather the reservoir drain (210) of FIG. 3 is the orifice through which the fluid in the tank reservoir (202) passes into the toilet bowl (not shown).

The sleeve bottom (206) of FIGS. 2A-D connects to the bottom (212 in FIG. 2A) of the toilet reservoir (202) around a reservoir drain (210 in FIG. 3). The sleeve bottom (206) of FIGS. 2A-D may connect to the bottom (212 in FIG. 2A) in a variety of ways. In the example of FIGS. 2A-D, the flush sleeve (204) connects to the bottom (212) of the toilet reservoir (202 in FIG. 2A) from the pressure of a flange sealing the bottom of the flush sleeve (204) to the bottom of the toilet reservoir (212). For further example, FIG. 4 sets forth a line drawing of a sectional view of section A-A shown on FIG. 2A of portions of the exemplary flush sleeve (204) and toilet reservoir (202). In the example of FIG. 4, the flush sleeve (204) connects to the bottom (212) of the toilet reservoir (202) by sealing the bottom flange (400A and 400B) of the flush sleeve (204) against the toilet reservoir (202) using fasteners (402A and 402B). The fasteners (402A-B) of FIG. 4 may be implemented as a combination of nuts and bolts or any other fastener as will occur to one of ordinary skill in the art. Of course, the bottom (206) of the flush sleeve (204) may connect to the bottom (212 in FIG. 2A) of the toilet reservoir (202 in FIG. 2A) in other ways as will occur to those of skill in the art such as, for example, using a water-proof adhesive.

Figure 2B:
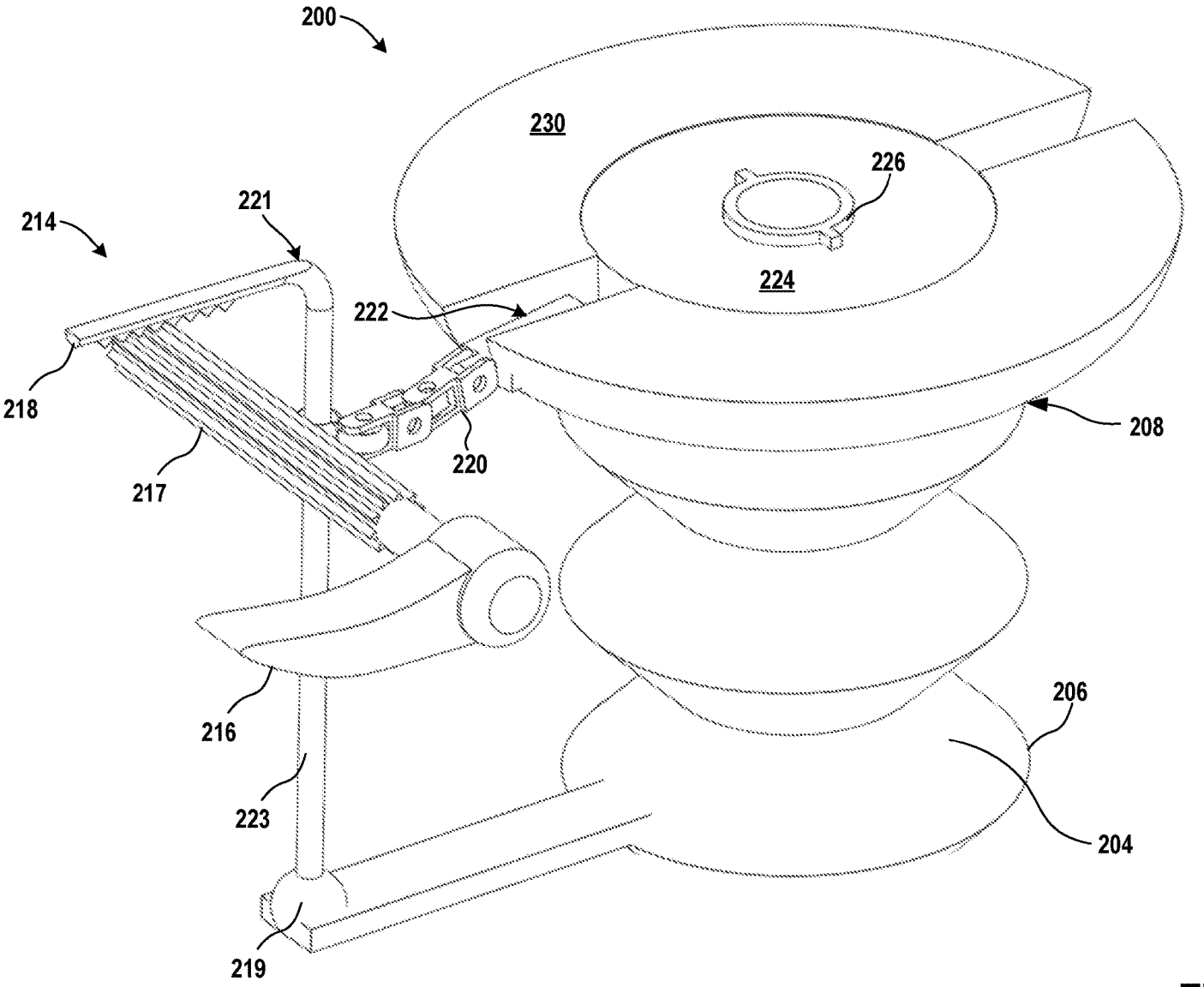
FIG. 2B set forth line drawings illustrating a perspective view of an exemplary toilet flushing system installed in a toilet reservoir according to embodiments of the present invention.
Figure 2C:
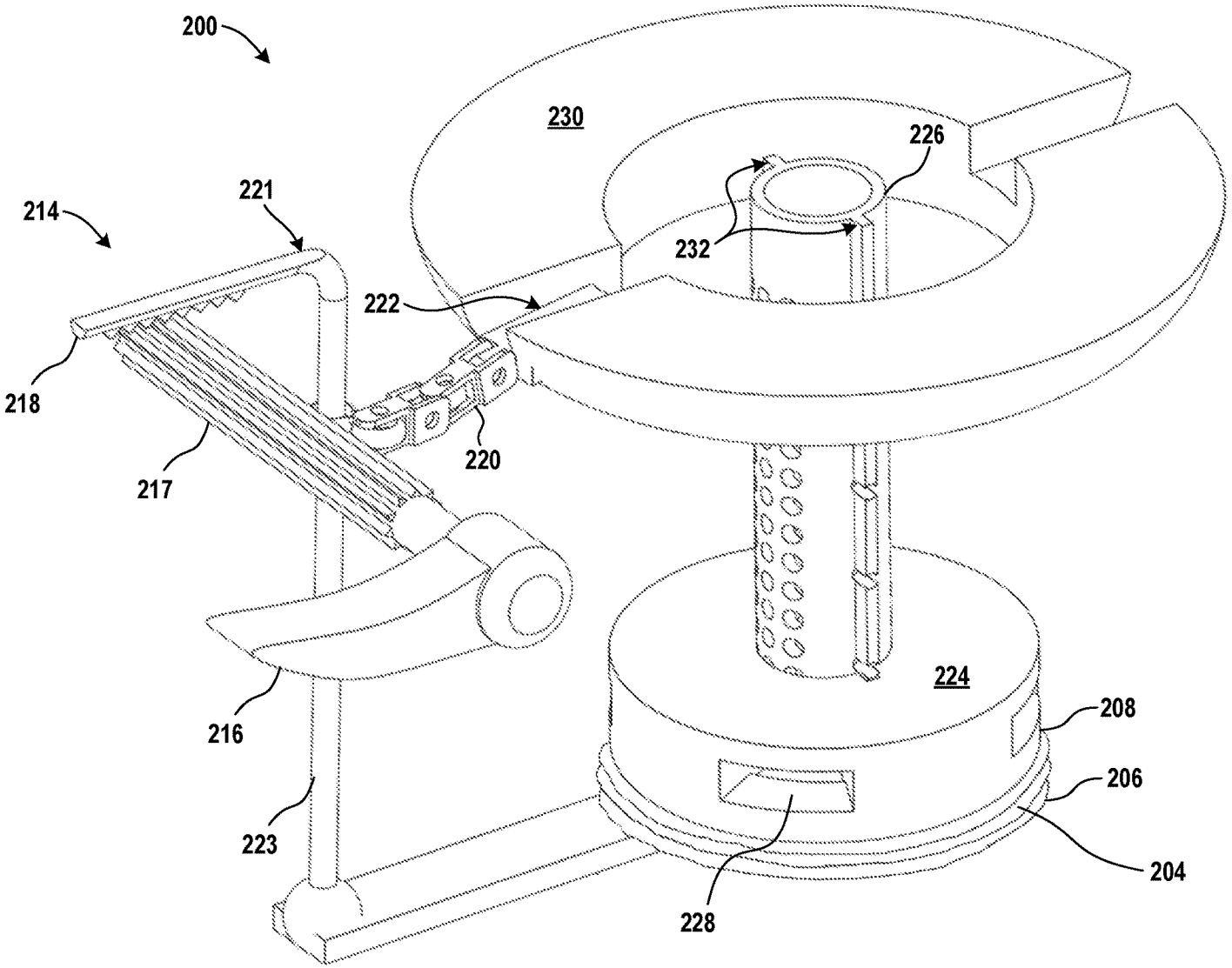
FIG. 2C set forth line drawings illustrating a perspective view of an exemplary toilet flushing system installed in a toilet reservoir according to embodiments of the present invention.
Figure 2D:
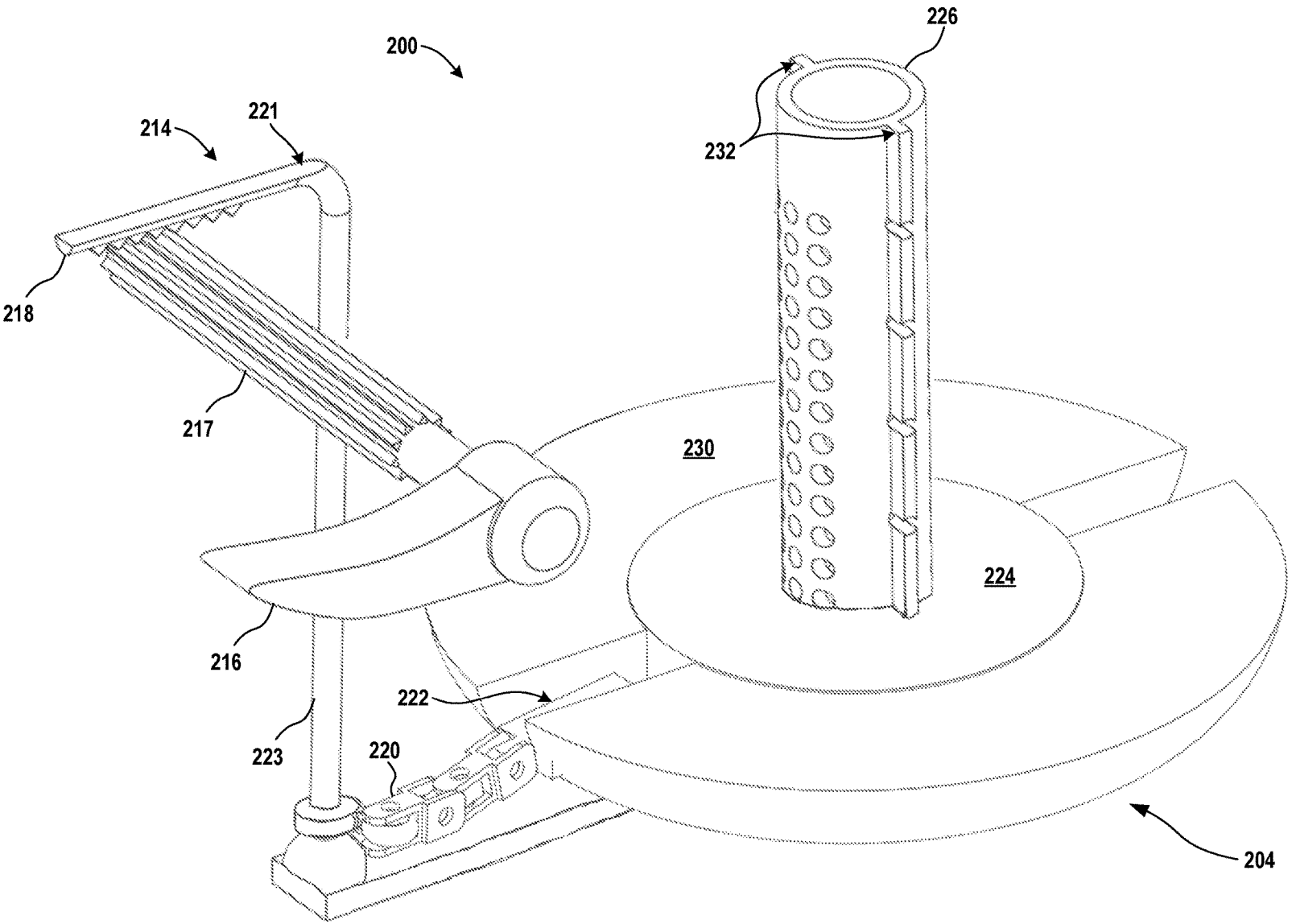
FIG. 2D set forth line drawings illustrating a perspective view of an exemplary toilet flushing system installed in a toilet reservoir according to embodiments of the present invention.
Figure 3:
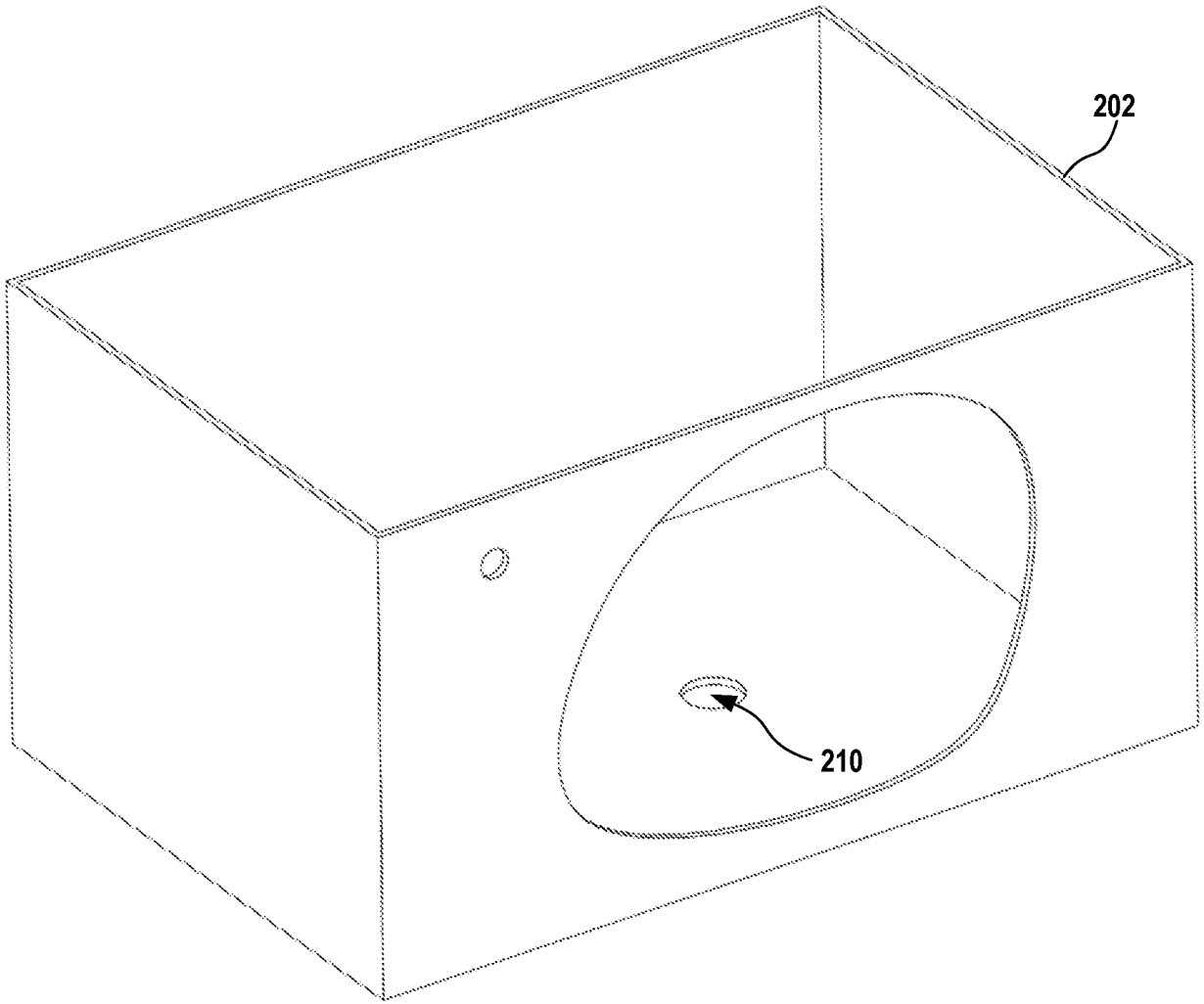
FIG. 3 sets forth a drawing illustrating a perspective view of the exemplary a toilet reservoir shown in FIGS. 2A-D according to embodiments of the present invention.
Figure 4:
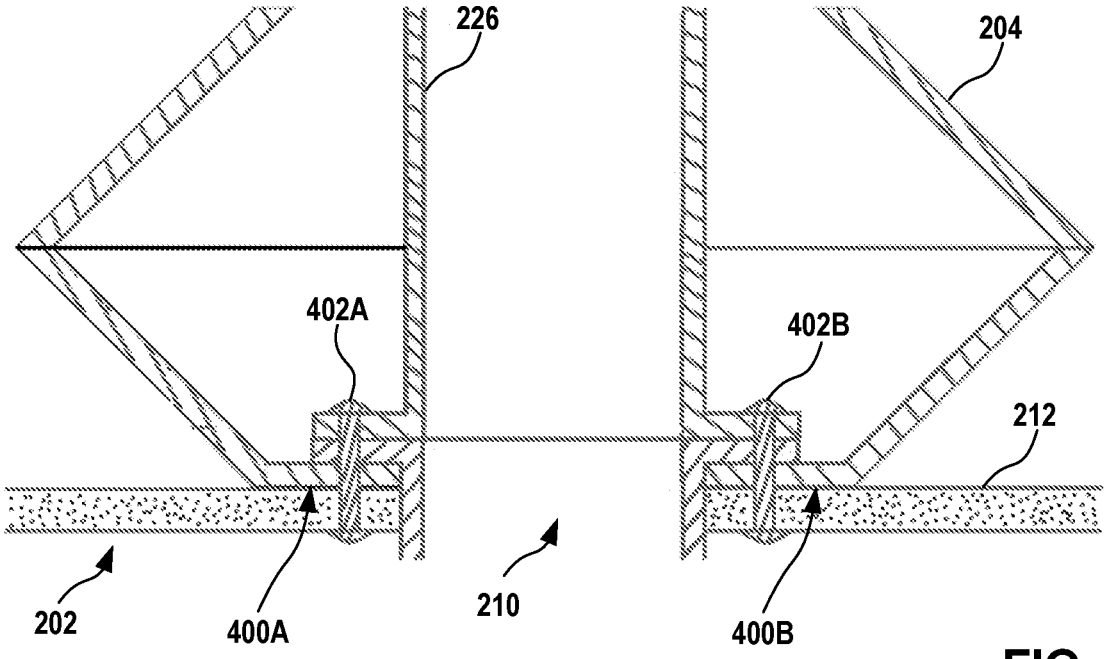
FIG. 4 sets forth a line drawing of a sectional view of section A-A shown on FIG. 2A of portions of the exemplary flush sleeve and toilet reservoir.

The flush sleeve (204) of FIGS. 2A-D is capable of being raised in a raised orientation such that the sleeve top (208) is above the fluid in the toilet reservoir to prevent the fluid from entering the reservoir drain (210 on FIGS. 3 and 4). FIGS. 2A and 2B depict the flush sleeve (204) in the raised position. When the flush sleeve (204) is configured in this raised position, the fluid level (not shown) in the toilet reservoir (202) of FIG. 2A will be below the top (208) of the flush sleeve (204). The fluid, therefore, will not be able to enter the central space inside the flush sleeve (204) and thereby down the reservoir drain (210 of FIGS. 3 and 4) into the toilet bowl (not shown). In the example of FIGS. 2A and 2B, the accordion structure of the flush sleeve (204) provides strength to the sleeve (204) so that the pressure of the fluid in the reservoir (202 in FIG. 2A) does not collapse the walls of the sleeve (204). Depending on the material used to construct the sleeve (204), additional reinforcements may be needed in the sleeve structure. For example, to utilize a lighter thinner material such as, for example, rubber, metal or plastic rings may be embedded in the ridges of the sleeve (204) to provide additional durability and strength so that the sleeve (204) maintains it structure and does not collapse under the pressure of the fluid in the reservoir (202 in FIG. 2A). Of course the sleeve could have structural enhancers beyond rings embedded in the ridges of the sleeve (204). Other structural enhancers that may be useful in embodiments of the present invention include forming an skeletal structure that has the accordion configuration and lining the interior and/or exterior of the structure with a water proof material. Of course, one of skill in the art will recognize that reinforcing the structure of the sleeve (204) is not necessary. That is, the sleeve (204) may merely be formed from a rigid enough material such that structural reinforcements such as rings at the ridges or a skeletal structure would not be necessary. For example, the sleeve (204) of FIGS. 2A-D may be made from certain plastics known to those of skill in the art that would not need to be reinforced. Those skilled in the art will recognize however that other materials may be useful such as for example rubber or waterproof fabric.

The toilet flushing system (200) of FIGS. 2A-D includes a flush sleeve actuator (214) that lowers the sleeve top (208) of the flush sleeve (204) below a fluid level in the toilet reservoir (202 in FIG. 2A) when the tank is full to allow the fluid to flow through the flush sleeve (204) into the reservoir drain (210 in FIGS. 3 and 4). In the example of FIGS. 2A-D, the flush sleeve actuator (214) includes a flush handle (216), rack (218), pinion (217) integrated in the arm of a L-bracket (221), universal joint linkage (220) and detent (222). As a user turns the flush handle (216) of FIGS. 2A-D, the pinion (217) drives the rack (218), which in turn moves the pinion (218) of the L-bracket (221). The L-bracket (221) of FIGS. 2A-D, which rotates on a ball hinge (219), then moves away from the flush sleeve (204) pulling the universal joint linkage (220) and thereby detent (222) out of a slot (228 on FIG. 2C) in a weighted sleeve collar (224) of FIGS. 2A-D. In this way, the detent (222) of FIGS. 2A-D operatively connects to a toilet tank handle (216) such that the detent (222) is removed from the collar slot (228 on FIG. 2C) when the toilet tank handle (216) is operated by a user.

As the detent (222) of FIGS. 2A-D slides out of the collar slot, the flush sleeve (204) drops below the fluid level in the toilet reservoir (202 in FIG. 2A) under the weight of the weighted sleeve collar (224). The weighted sleeve collar (224) of FIGS. 2A-D operates as a weight that pushes the flush sleeve (204) toward the bottom of the reservoir (202 in FIG. 2A). The weighted sleeve collar (224) of FIGS. 2A-D may be implemented using a variety of materials such as for example metal, dense plastic that does not float, and many others as will occur to those of skill in the art. In other embodiments, a weighted sleeve collar (such as 224) may not be needed because the weight of an exemplary flush sleeve may be enough to push the entire flush sleeve (204) toward the bottom of the toilet reservoir (202 in FIG. 2A).

In the example of FIGS. 2A and 2B, the flush sleeve (204) is held up in the raised position by a float collar (230) surrounding the flush sleeve (204). The float collar (230) of FIGS. 2A and 2B engages with the flush sleeve (204) via the detent (222) that slides along a channel in the float collar (222) to penetrate into a slot (not shown) in the weighted sleeve collar (224). Portions of the slot in the weighted sleeve collar (224) and/or portions of the detent (222) may be implemented using magnetic materials to assist the continued engagement of the detent (222) in the collar slot of the weighted sleeve collar (224) in the example of FIGS. 2A-D. The float collar (230) of FIGS. 2A-D is buoyant relative to the density of the fluid used to fill the reservoir (202 of FIG. 2A) and flush waste from the toilet. In this manner, the float collar (230) of FIGS. 2A-D floats on top of the fluid in the reservoir as the fluid level in the reservoir (202 of FIG. 2A) rises and falls during the toilet flush cycle. Examples of buoyant materials may include Styrofoam, low density plastics, wood, and many other materials as will occur to those of skill in the art. In addition, the float collar (230) of FIGS. 2A-D may be formed as a hollow shell that primarily contains air.

When the flush sleeve actuator (214) of FIGS. 2A and 2B disengages the detent (222) from the weighted sleeve collar (224) of the flush sleeve (204), the weighted sleeve collar (224) compresses the flush sleeve (204) downward toward the bottom (212 in FIG. 2A) of reservoir (202 in FIG. 2A)—resulting in the configuration shown on FIG. 2C. In FIG. 2C, the weighted sleeve collar (224) of FIG. 2C has enough mass to sink through the fluid of the reservoir (202 in FIG. 2A) when the detent (222) disengages from the slot (228) of the weighted sleeve collar (224).

As the flush sleeve (204) collapses under the weight of the weighted sleeve collar (224) in the example of FIGS. 2A-D, an inner sleeve tube (226) is exposed. The inner sleeve tube (226) of FIGS. 2A-D is tube extending upward from the reservoir drain (210 of FIG. 4) inside the weighted sleeve collar (224) to guide the weighted sleeve collar (224) vertically inside the toilet reservoir (202 of FIG. 2A). The inner sleeve tube (226) of FIGS. 2A-D has a large number of small openings to allow the fluid from the reservoir (202) to flow into the reservoir drain (210 of FIG. 4) when the flush sleeve (204) drops below the fluid level in the toilet reservoir (202 of FIG. 2A). Although the inner sleeve tube (226) of FIGS. 2A-D has many small openings, this configuration is for example only and not for limitation. In other embodiments, an inner sleeve tube useful in embodiments of the present invention may only one or two larger opening. Regardless of the number of openings in an inner sleeve tube, the combination of the number of openings and size of the openings should be designed to permit a sufficient fluid volume to flow through the inner sleeve tube (226) and out of the reservoir drain (210 of FIG. 4). In this way, the toilet bowl fills rapidly enough to create the siphonic action that carries the waste away from the toilet.

In the example of FIGS. 2A-D, the toilet flushing system (200) includes two sleeve rails (232) to guide the weighted sleeve collar (224) vertically inside the toilet reservoir (202 of FIG. 2A). The sleeve rails (232) of FIGS. 2A-D are formed into the inner sleeve tube (226) and keep the flush sleeve (204), including the weighted sleeve collar (224), oriented properly as the flush sleeve (204) moves vertically up and down inside the toilet reservoir (202 of FIG. 2A).

After the flush sleeve (204) in FIGS. 2A-D collapses to the bottom of the toilet reservoir (202 of FIG. 2A), the fluid in the reservoir begins to flow down the reservoir drain (210 in FIGS. 3 and 4). As the fluid flows out of the reservoir (202 of FIG. 2A), the float collar (230) begins a descend downward toward the bottom (212 of FIG. 2A) of the reservoir (202 of FIG. 2A). In the example of FIGS. 2A-D, the toilet flushing system (200) includes a float rail (223) to guide the float collar (230) vertically inside the toilet reservoir. The float rail (223) positions the float collar (230) to engage the flush sleeve (204) as the float collar (230) descends with the fluid level in the reservoir tank. Specifically, the descent of the float collar (230) of FIGS. 2A-D is guided by rail (223) formed from the L-bracket (221). The float collar (230) of FIGS. 2A-D is tethered to the rail (223) via the universal joint linkage (220) and detent (222), which rests in a groove of the float collar (230). Of course, using the rail (221) of the flush sleeve actuator (214) of FIGS. 2A-D to guide the float collar (230) vertically in the reservoir (202 of FIG. 2A) is for example only and not for limitation. Other guide rails not connected to the flush sleeve actuator (214) may also be configured in the toilet reservoir (202 of FIG. 2A) to guide the float collar (230).

FIG. 2D depicts the configuration of the float collar (230) when the float collar (230) of FIGS. 2A-D has reached the limits of the descent downward in the reservoir (202 of FIG. 2A). At this point, the detent (222) re-engages into a slot (228 of FIG. 2C) formed in the weighted sleeve collar (224) of the flush sleeve (204). The detent (222) configured on the float collar (230) slides into the collar slot (228 of FIG. 2C) on the flush sleeve (204) to engage the float collar (230) with the flush sleeve (204) such that the flush sleeve (204) rises with the fluid level on which the float collar (230) floats. This re-engagement may be implemented by forming portions of the detent (222) or the slot (228 of FIG. 2C) from magnetic materials so that as soon as the float collar (230) descends low enough in the toilet reservoir (202 of FIG. 2A) the magnetic attraction between the detent (222) and the slot (228 of FIG. 2C) would draw the detent (222) into the slot (228 of FIG. 2C). Once the detent (222) of FIGS. 2A-D is engaged in the weighted sleeve collar (224), the collar (224)—and thereby the flush sleeve (204)—will rise with the float collar (230) as the reservoir fills back up with fluid. When the reservoir (202 of FIG. 2A) is full, the float collar (230), weighted sleeve collar (224), and flush sleeve (204) will return to the configuration depicted in FIGS. 2A and 2B.

In the example of FIGS. 2A-D, the exemplary flushing system uses a detent engaging into a slot as the mechanism for connecting the flush sleeve with the float collar. Such an example is for explanation only and not for limitation. In other embodiments, the float collar and flush sleeve may be composed in portions of certain magnetic material that would allow the float collar and the flush sleeve to connect together based on their own magnetic attraction to one another. In such embodiments, the beginning of the flush cycle would start with the disengagement of the flush sleeve from the float collar by exerting mechanical force to overcome the magnetic attraction of the two components. This would allow the flush sleeve to descent in a reservoir tank. As the fluid level lowers in the reservoir, the float collar would get closer to the flush sleeve and then re-engage using the magnetic attraction of the two forces.

The exemplary flushing system (200) of FIGS. 2A-D utilizes a flush sleeve (204), weighted sleeve collar (224), inner sleeve tube (226), and float collar (230) that are substantially round or circular in configuration. The round or circular configuration is for example only and not for limitation. In other embodiments, these components for use in exemplary flushing systems according to embodiments of the present invention may be substantially configured to match other shapes such as squares, rectangles, ovals, or any other shapes as will occur to those of skill in the art. Different shaped components may be better suited for some reservoir tanks employing such exemplary flushing system occur to embodiments of the present invention.

Figure 5:
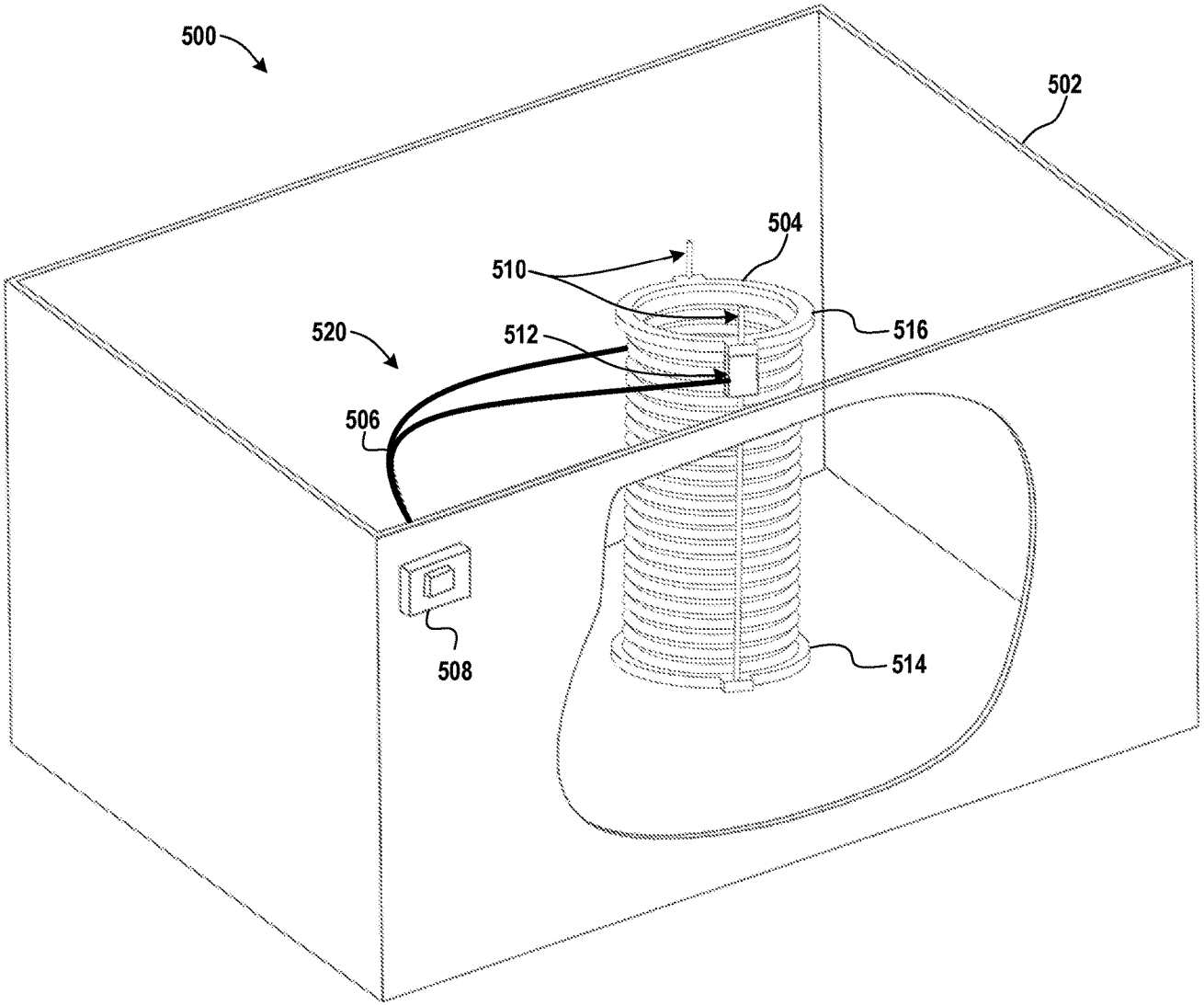
FIG. 5 set forth line drawings illustrating a perspective view of an exemplary toilet flushing system installed in a toilet reservoir according to embodiments of the present invention.

In the example of FIGS. 2A-D, the exemplary flushing system (200) utilized a mechanical flush sleeve actuator (214), an inner sleeve tube (226) and the rails (232) of the flush sleeve (204) extended vertically in the interior of the flush sleeve (204). This particular embodiment is for example only and not for limitation. Turning to FIG. 5, FIG. 5 set forth line drawings illustrating a perspective view of an exemplary toilet flushing system (500) installed in a toilet reservoir (502) according to embodiments of the present invention. The toilet flushing system (500) of FIG. 5 is installed in a toilet reservoir (502). The toilet reservoir (502)

of FIG. 5 stores a fluid that pours into a toilet bowl for carrying waste away from a toilet.

The toilet flushing system (500) of FIG. 5 includes a flush sleeve (504). In the example of FIG. 5, the flush sleeve (504) has a sleeve bottom (514) and sleeve top (516). The sleeve bottom (514) of FIG. 5 connects to a bottom of the toilet reservoir (502) around a reservoir drain (not shown). The flush sleeve (504) of FIG. 5 is capable of being raised in a raised orientation (shown in FIG. 5) such that the sleeve top is above the fluid (not shown) in the toilet reservoir (502) to prevent the fluid from entering the reservoir drain.

The toilet flushing system (500) of FIG. 5 includes a flush sleeve actuator (520). The flush sleeve actuator (520) of FIG. 5 lowers the sleeve top (516) of the flush sleeve (504) below a fluid level (not shown) in the toilet reservoir (502) to allow the fluid to flow through the flush sleeve (504) into the reservoir drain.

In the example of FIG. 5, the toilet flushing system (500) includes two sleeve rails (510) to guide the flush sleeve (504) vertically inside the toilet reservoir (502). The sleeve rails (510) of FIG. 5 include many small openings to allow gears inside the motorized gearbox (512) to traverse up and down the sleeve rails (510). The motorized gearbox (512) of FIG. 5 is controlled by an electronic flush button (508) mounted on the tank (502) of the toilet. The motorized gearbox (512) connects to the flush button (508) through electrical power and signal wires (506). The electrical power and signal wires (506) of FIG. 5 are encased in a water-proof coating to avoid an electrical short. The wire (506) provides electrical power to the motorized gearbox (512) via batteries installed beneath the surface of the flush button (508).

In addition to providing electrical power, the electrical power and signal wires (506) of FIG. 5 carry a flush signal from the flush button (508) to the motorized gearbox (512) to initiate a flush cycle when a user presses the flush button (508). The flush signal may be implemented as a series of encoded '1' and '0' that instructs the motorized gearbox (512) to begin the flush cycle. Alternatively, the flush signal could be analogue based and simply implemented as the raising of the voltage between a pair of the signal wire (506) above a predetermined threshold.

When the motorized gearbox (512) of FIG. 5 detects a flush signal from the flush button (508), the gears of the motorized gearbox (512) start to turn—catching the small openings (not shown) along the sleeve rails (510). As the gears of the motorized gearbox (512) turn, the gearbox (512) traverses down the sleeve rails (510). Because the gearbox (512) is attached to the top (516) of the flush sleeve (504), as the gearbox (512) traverses down the sleeve rails (510), the flush sleeve (504) is lowered below the fluid level in the reservoir (502). As the flush sleeve (504) of FIG. 5 is lowered, the fluid enters the central region of the flush sleeve (504) and flows out of the reservoir drain (not shown) at the base of the reservoir (502) and into the toilet bowl (not shown). The gearbox (512) moves rapidly enough down the sleeve rails (510) to allow the fluid to quickly enter the center of the flush sleeve (504) and flow into the toilet bowl at a sufficient rate to initiate the siphoning action required to flush the toilet bowl. Once the reservoir (502) of FIG. 5 is substantially empty of the fluid and starts to refill, the gearbox (512) reverses direction and moves back up the sleeve rails (510) and return to the original position as shown in FIG. 5.

The gearbox (512) of FIG. 5 may determine when to stop the downward traversal of the sleeve rails (510), may determine how long to remain at the bottom of the sleeve rails (510) with the flush sleeve (504) lowered, and may determine when to stop the upward traversal back to the original position on the sleeve rails (510) using timers embedded in the motorized gearbox (512). Alternatively, the motorized gearbox (512) of FIG. 5 may determine the stop points along the sleeve rails (510) by detecting certain contact points along the sleeve rails (510) that indicate stop positions. Of course there are a variety of other mechanisms that could be employed in the motorized gearbox (512) of FIG. 5 so that the gearbox (512) stops at the appropriate points along the sleeve rails (510) and for the appropriate amount of time to allow the fluid to flow from the reservoir (502) into the toilet bowl as will occur to those of skill in the art.

In the exemplary flushing systems of FIGS. 2A-D and FIG. 5, the exemplary inner sleeve tubes and exemplary sleeve rails are for example only and not for limitation. In other embodiments, an exemplary inner sleeve tube could be configured such that the openings in the inner sleeve tube are at the upper end of the inner sleeve tube so that, as the flush sleeve descends, the fluid level only drops to the lowest opening in the inner sleeve tube. Similarly, an exemplary sleeve rail could be configured with certain stops in place to limit the descent of the flush sleeve. In this manner, the amount of water utilized per flush can be controlled no matter the total volume of the reservoir tank. Such embodiments may be useful in conversion of an older 6 gallon tank to a 1.6 gallon low flush toilet—not by changing the dimensions of the tank but rather by limiting the amount of water that is allowed to enter the toilet bowl.

The example toilet flushing systems of FIGS. 2A-D and FIG. 5 utilize either an exemplary float collar or exemplary motorized gearbox to return the flush sleeve to its original, pre-flush position where the top of the flush sleeve is above the fluid level in the exemplary reservoirs. Both of these embodiments are for example only and not for limitation. Other exemplary flushing systems according to embodiments of the present invention may include a flush sleeve with a built-in compression spring that is used to return the flush sleeve back to the original pre-flush position with the top of the flush sleeve above the fluid level in the reservoir tank. In such embodiments, a user may actuate a handle or pedestal that through a mechanical linkage pushes or pulls the top of the flush sleeve below the fluid level in the reservoir to begin the flushing action. The energy stored in the compression spring would be utilized to return the flush sleeve to the uncompressed position. The compression spring could be built into the wall of the flush sleeve or it could be part of the sleeve rails used to the guide the flush sleeve in some embodiments.

Figure 6A:
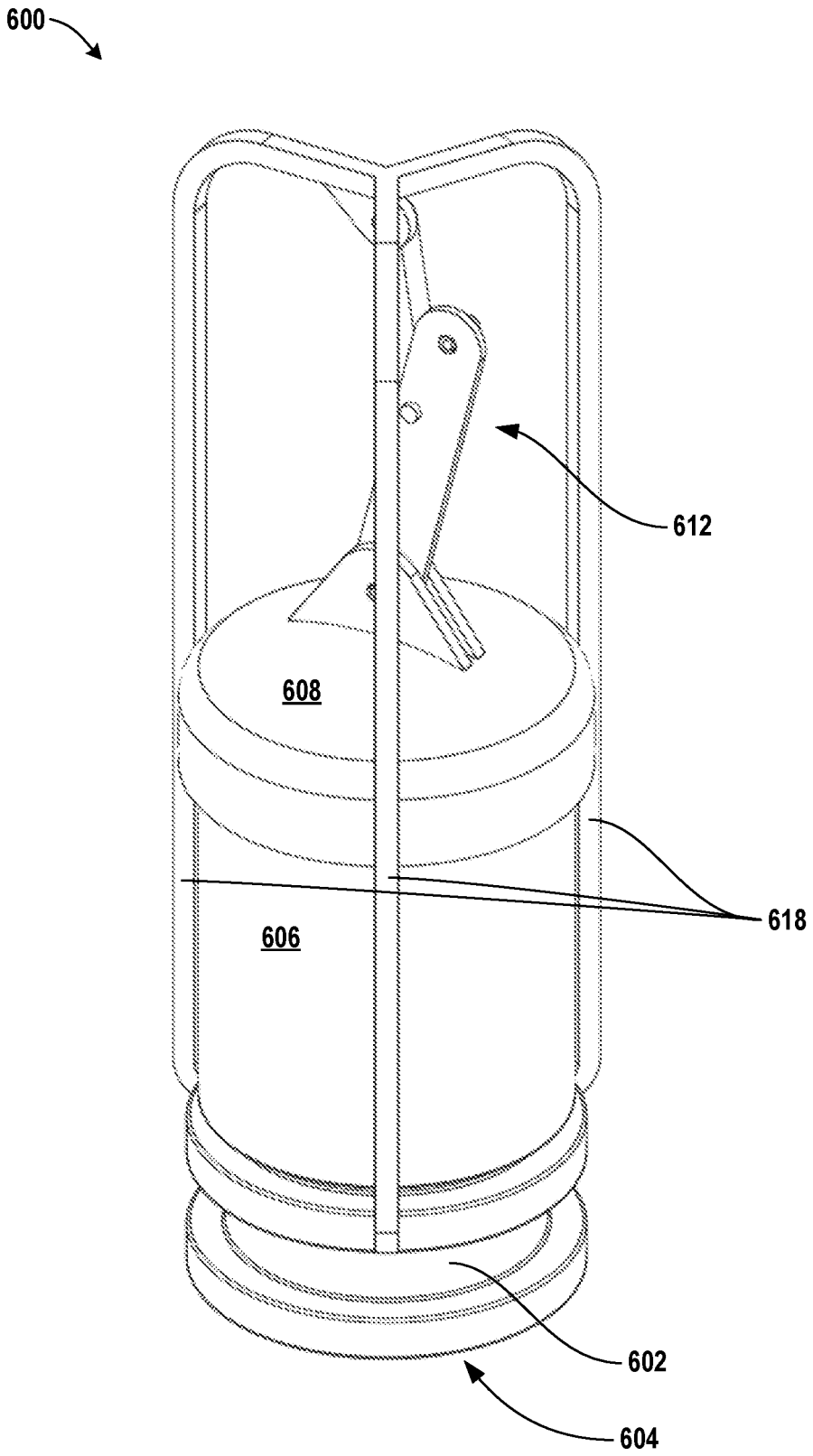
FIG. 6A sets forth a line drawing illustrating a perspective view of an exemplary toilet flushing system for installation in a toilet reservoir according to embodiments of the present invention.
Figure 6B:
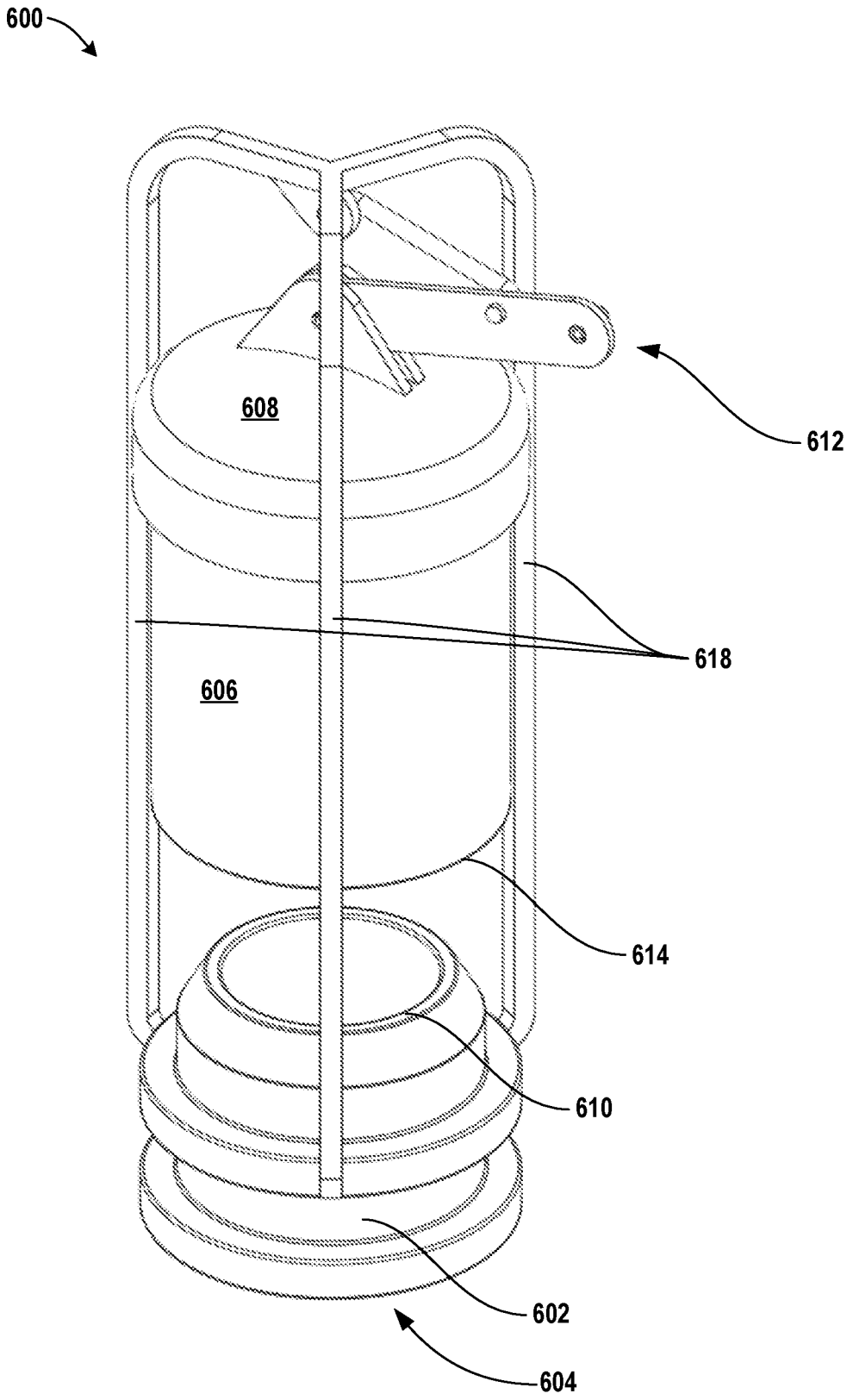
FIG. 6B sets forth a line drawing illustrating a perspective view of an exemplary toilet flushing system for installation in a toilet reservoir according to embodiments of the present invention.

The exemplary toilet flushing systems of FIGS. 2-5 according to embodiments of the present invention operate by sealing a flush sleeve to the bottom of a toilet reservoir and then lowering or raising the top of the flush sleeve depending on whether an operator desires to flush the toilet or fill the tank reservoir back up. In the example of FIGS. 6A-B, this exemplary flush sleeve system (600) operates by opening and closing the reservoir drain by placing an air pocket over the drain to close it and removing the air pocket to open the reservoir drain.

Turning to FIGS. 6A-B, FIGS. 6A-B set forth a line drawing illustrating a perspective view of an exemplary toilet flushing system (600) for installation in a toilet reservoir (not shown) according to embodiments of the present invention. The exemplary toilet flushing system (600) of FIGS. 6A-B is configured for installation in a toilet reservoir (not shown). As previously mentioned, the reservoir stores a fluid that pours into a toilet bowl for carrying waste away from a toilet.

The exemplary toilet flushing system (600) of FIGS. 6A-B includes a reservoir drain pipe (602) extending upward from a reservoir drain (604) in a base of the toilet reservoir. The reservoir drain pipe (602) of FIGS. 6A-B is the pipe through which the fluid of the reservoir flows to enter the toilet bowl. The height that the reservoir drain pipe (602) extends upward from the base of the reservoir may vary from one embodiment to another, but the height should be enough so that a bubble or pocket of air or other gas may rest over the top of the drain pipe (602) and block entry of any fluid from the reservoir. At the same time, however, any fluid below the top of the reservoir drain pipe (602) will not be available to fill the toilet bowl and start the siphoning action because fluid below the top of the drain pipe (602) will not be able to enter into the reservoir drain and make it to the toilet bowl. According the user of the exemplary toilet flushing system (600) depicted in FIGS. 6A-B will need to adjust the reservoir drain pipe (602) height depending on the overall geometry of the toilet reservoir into which it is installed. Additional factors that might affect the height of the reservoir drain pipe (602) may include the location and altitude of the toilet into which the system is installed. The location and altitude may affect the density of the air pocket inside a flush cap, which in turn affects how much the surrounding fluid will be able to compress the air pocket inside a flush cap. The less dense the air in the flush cap, the more the air will compress and therefore the height of the reservoir drain pipe will need to be higher so that the air pocket still seats around the top of the exemplary drain pipe.

In the example of FIGS. 6A-B, the exemplary toilet flushing system (600) of FIGS. 6A-B includes a flush cap (606). The flush cap (606) of FIGS. 6A-B is essentially a dome or similar structure that can trap a pocket of air inside the cap (606). As will occur to those of skill in the art, a variety of shape will suffice so long as the bottom of an exemplary flush cap is the only portion of the flush cap that is open. In this way, as fluid surrounds the flush cap (606) of FIGS. 6A-B, air from the toilet tank is trapped inside the flush cap (606). In the example of FIG. 6A, the flush cap (606) is connected around the reservoir drain pipe (602) in a closed position that prevents the fluid from entering the reservoir drain (604). The flush cap (606) of FIG. 6A has a sealed top (608) that traps air inside the flush cap (606) forcing the fluid below a top (610 in FIG. 6B) of the reservoir drain pipe (602) when the flush cap (606) is lowered to the closed position.

The exemplary toilet flushing system (600) of FIGS. 6A-B includes a flush cap actuator (612) connected to the flush cap (606). The flush cap actuator (612) of FIGS. 6A-B raises the flush cap (606) to an open position such that a bottom (614) of the flush cap (606) is positioned above the top (610) of the reservoir drain pipe (602) to allow the fluid to flow through the reservoir drain pipe (602) into the reservoir drain (604). By raising the flush cap (606) of FIGS. 6A-B, the pocket or bubble of air trapped inside the flush cap (606) is lifted off of the top of the reservoir drain pipe (602) and fluid is then allowed to flow through the reservoir drain (604) and into the toilet bowl to start the siphonic flushing action.

In the example of FIGS. 6A-B, the toilet flushing system (600) includes one or more cap guides (618) positioned vertically around the flush cap (606) to maintain a vertical orientation of the flush cap (606) over the reservoir drain pipe (602) as the flush cap (606) moves up and down. These cap guides (618) prevent the flush cap (606) from getting off position such that the cap (606) no longer seats on top of the reservoir drain pipe (602). These guides (618) also serve to keep the flush cap (606) from rotating in any axis except its central, vertical axis-thereby keeping the bottom of the flush cap (606) oriented in the downward direction so that the pocket of air stays trapped inside the cavity of the flush cap (606).

Although not shown with respect to FIGS. 6A-B, the flush cap (606) of FIGS. 6A-B is operatively connected to a toilet tank handle such that the flush cap (606) is raised, unlocked, or allowed to rise when the toilet tank handle is operated by a user. In some embodiments, this operative connection may take the form of a mechanical linkage as will occur to those of skill in the art, and in other embodiments this operative connection may be implemented using a servo motor connected to an electronic processing unit that receives a signal from a user when that user presses a flush push-button.

The flush cap (606) of FIGS. 6A-B may be configured such that a gap exists between an inner surface of the flush cap (606) and an outer surface of the drain pipe (602) even when the flush cap (606) is in the closed position. By configuring a gap between the inner surface of the flush cap (606) and the outer surface of the drain pipe (602) in the example of FIGS. 6A-B, an overflow hose from the reservoir filling mechanism may be easily inserted into the drain pipe (602). In this way, if the reservoir filling mechanism malfunctions and continues to fill the toilet reservoir, the overflow tube can deliver the water to pipe drain (604) and then the toilet bowl.

In the example of FIGS. 6A-B, the flush cap (606) is raised and lowered vertically over the reservoir drain pipe (602). In other embodiments, an exemplary flush cap may be attached to a hinged arm and be rotated on and off of an exemplary reservoir drain pipe. As an exemplary flush cap rotates off of the top of such exemplary reservoir drain pipe, the fluid in the reservoir is allowed to enter the drain pipe and flow into the toilet bowl. When the fluid in the reservoir is empty, such exemplary flush cap sits back on the reservoir drain pipe. As the fluid fills the reservoir from the filling mechanism, the fluid surround the flush cap but is not able to reach the top of the drain pipe because the pocket of air trapped inside the flush cap keeps the fluid from entering into the flush cap far enough to get over the top of the reservoir drain pipe.

While certain exemplary embodiments have been described in details and shown in the accompanying drawings, it is to be understood that such embodiments are merely illustrative of and not devised without departing from the basic scope thereof, which is determined by the claims that follow.

We claim:

1. A toilet flushing system installed in a toilet reservoir, the toilet reservoir for storing a fluid that pours into a toilet bowl for carrying waste away from a toilet, the toilet flushing system comprising:

a flush sleeve having a sleeve bottom and sleeve top, the sleeve bottom connected to a bottom of the toilet reservoir around a reservoir drain, the flush sleeve in a raised orientation when the sleeve top is above the fluid in the toilet reservoir to prevent the fluid from entering the reservoir drain;

a flush sleeve actuator that lowers the sleeve top of the flush sleeve below a fluid level in the toilet reservoir to allow the fluid to flow through the flush sleeve into the reservoir drain; and a float collar configured around the flush sleeve, the float collar configured to float on the fluid in the toilet reservoir.

2. The toilet flushing system of claim 1 wherein the flush sleeve actuator further comprises a detent configured on the float collar that slides into a collar slot on the flush sleeve to engage the float collar with the flush sleeve such that the flush sleeve rises with the fluid level on which the float collar floats.

3. The toilet flushing system of claim 2 wherein a least a portion of the detent is configured from magnetic material.

4. The toilet flushing system of claim 2 wherein a least a portion of the collar slot is configured from magnetic material.

5. The toilet flushing system of claim 2 further comprising one or more float rails to guide the float collar vertically inside the toilet reservoir, the one or more float rails positioning the float collar to engage the flush sleeve as the float collar descends with the fluid level in the reservoir tank.

6. The toilet flushing system of claim 2 wherein the detent is operatively connected to a toilet tank handle such that the detent is removed from the collar slot when the toilet tank handle is operated by a user.

* * * * *